US009085022B2

(12) United States Patent
Horii et al.

(10) Patent No.: US 9,085,022 B2
(45) Date of Patent: Jul. 21, 2015

(54) MANUFACTURING DEVICE AND MANUFACTURING METHOD FOR HOT-ROLLED STEEL STRIP

(75) Inventors: Kenji Horii, Hiroshima (JP); Yuji Ikemoto, Hiroshima (JP); Koichi Takeno, Hiroshima (JP); Manabu Eto, Tokyo (JP); Yoshiro Washikita, Tokyo (JP)

(73) Assignees: MITSUBISHI-HITACHI METALS MACHINERY, INC., Tokyo (JP); NIPPON STEEL & SUMITOMO METAL CORPORATION, Tokyo (JP)

( * ) Notice: Subject to any disclaimer, the term of this patent is extended or adjusted under 35 U.S.C. 154(b) by 301 days.

(21) Appl. No.: 13/876,360

(22) PCT Filed: Sep. 5, 2011

(86) PCT No.: PCT/JP2011/070108

§ 371 (c)(1),
(2), (4) Date: Jun. 6, 2013

(87) PCT Pub. No.: WO2012/043148

PCT Pub. Date: Apr. 5, 2012

(65) Prior Publication Data

US 2013/0247638 A1 Sep. 26, 2013

(30) Foreign Application Priority Data

Sep. 28, 2010 (JP) ..... 2010-216352

(51) Int. Cl.
*B21B 1/26* (2006.01)
*B21B 37/76* (2006.01)
(Continued)

(52) U.S. Cl.
CPC . *B21B 1/26* (2013.01); *B21B 37/76* (2013.01); *B21B 45/0218* (2013.01);
(Continued)

(58) Field of Classification Search
CPC ..... B21B 1/26; B21B 37/76; B21B 38/02; B21B 39/08; B21B 45/0218; B21B 39/06; B21B 2261/20; B21B 2265/02; B21C 51/00
USPC ..... 72/234
See application file for complete search history.

(56) References Cited

U.S. PATENT DOCUMENTS 4,358,887 A * 11/1982 Creps ..... 72/372
5,636,543 A * 6/1997 Kajiwara et al. ..... 72/234
(Continued)

FOREIGN PATENT DOCUMENTS

CN 101189080 A 5/2008
JP 61-193713 A 8/1986
(Continued)

OTHER PUBLICATIONS

"Theory and Practice of Strip Rolling", The Iron and Steel Institute of Japan, Sep. 1, 1984 with English Abstract.
(Continued)

*Primary Examiner* — David B Jones
(74) *Attorney, Agent, or Firm* — Birch, Stewart, Kolasch & Birch, LLP

(57) ABSTRACT

In order to provide a manufacturing device and a manufacturing method for a hot-rolled steel strip, which are capable of obtaining the desired quality of material by rapid uniform cooling immediately after rolling, and improving yield by early sheet tension and sheet shape measurements, a manufacturing device for a hot-rolled steel strip is provided with a finishing rolling mill line (11), a first cooling unit (13) installed just behind the exit side of the finishing rolling mill line, and a pinch roll (14) which is installed on the exit side of the first cooling unit and in contact with both the upper and lower surfaces of a strip (S), at least a wiping roll (15) located on the upper side of the strip (S) is disposed between the first cooling unit and the pinch roll, and a tension/shape measuring unit (16) for measuring the tension and shape of the strip (S); is installed between the wiping roll and the pinch roll.

18 Claims, 8 Drawing Sheets

(51) Int. Cl.

| | |
|---|---|
| ***B21B 45/02*** | (2006.01) |
| ***B21C 51/00*** | (2006.01) |
| *B21B 38/02* | (2006.01) |
| *B21B 39/08* | (2006.01) |
| *B21B 39/00* | (2006.01) |

(52) U.S. Cl.

CPC ..... *B21C 51/00* (2013.01); *B21B 38/02* (2013.01); *B21B 39/006* (2013.01); *B21B 39/08* (2013.01); *B21B 2261/20* (2013.01); *B21B 2265/02* (2013.01)

(56) References Cited

U.S. PATENT DOCUMENTS

| | | | |
|---|---|---|---|
| 7,856,894 | B2 | 12/2010 | Kipping et al. |
| 8,051,692 | B2 | 11/2011 | Hayashi et al. |
| 2008/0134739 | A1 | 6/2008 | Hayashi et al. |

FOREIGN PATENT DOCUMENTS

| | | | |
|---|---|---|---|
| JP | 2001-246414 | A | 9/2001 |
| JP | 2003-136108 | A | 5/2003 |
| JP | 2004-290989 | A | 10/2004 |
| JP | 2005-66614 | A | 3/2005 |
| JP | 2005-342767 | A | 12/2005 |
| JP | 3801145 | B2 | 5/2006 |
| JP | 2006-346714 | A | 12/2006 |
| JP | 2009-512561 | A | 3/2009 |

OTHER PUBLICATIONS

International Search Report for International Application No. PCT/JP2011/070108 (PCT/ISA/210, PCT/ISA/237, PCT/ISA/220).

S. P. Timoshenko, J. N. Goodier, "Theory of Elasticity Third Edition", McGraw-Hill Book Company International Edition 1970.

Korean Office Action dated Apr. 23, 2014 issued in corresponding application No. 2013-7007610.

Chinese Office Action dated May 29, 2014 issued in corresponding CN Application No. 201180046094.0 with English Translation.

* cited by examiner (a) Measurement Result of Shape Meter (b) Strip-Widthwise Temperature Distribution (c) Strip-Widthwise Distribution of Elongation difference (d) Pre-Cooling Shape on Delivery Side of Finishing Mill Line (e) Target Shape (a) Calculation Model (b) Relationship between Width Position and Coefficient K at y = 0 when C = 0.5 W (c) Relationship between Distance from Action Point/ Strip Width and K Value (K0) at Strip Width Center (d) Relationship between Distance from Action Point/Strip Width and Conversion Shape Δshape at Strip Width Center

MANUFACTURING DEVICE AND MANUFACTURING METHOD FOR HOT-ROLLED STEEL STRIP

TECHNICAL FIELD

The present invention relates to a manufacturing device and a manufacturing method for a hot-rolled steel strip, and in particular to a manufacturing device and a manufacturing method for a hot-rolled steel strip, which are capable of obtaining a hot-rolled steel strip of desired material by rapid cooling immediately after rolling, and capable of producing a hot-rolled steel strip in good yield.

BACKGROUND ART

Hot rolling equipment of this type is disclosed, for example, in Patent Literatures 1 and 2. Specifically, Patent Literature 1 has an object to obtain a high-yield hot rolling system or the like capable of conveying a rolled strip stably even using a cooling bank for performing intensive cooling at high water pressure and high flow rate. Patent Literature 1 states that pinch rolls are disposed immediately in the vicinity of a delivery side of a cooling apparatus, and a tension detecting device detects tension of a rolled strip based on a value of current fed to a drive motor of the pinch rolls.

In addition, Patent Literature 2 has an object to increase a cooling efficiency in a runout table as much as possible and to minimize the time required for rolling. Patent Literature 2 states that, in a case where a damming (draining) roll in a cooling apparatus installed on a delivery side of a finishing mill line is brought into close contact with a steel strip, the damming roll is pressed against the steel strip with predetermined pressing force and drive torque is applied to the damming roll, so that the damming roll serves also as pinch rolls. This is thought to cause tension to act on the steel strip as early as possible to create a stable rolling state early.

CITATION LIST

Patent Literature

Patent Literature 1: Japanese Patent Application Laid-Open No. 2003-136108

Patent Literature 2: Japanese Patent Application Laid-Open No. 2005-342767

Patent Literature 3: Japanese Patent Application Laid-Open No. 2005-66614

Patent Literature 4: Japanese Patent Application Laid-Open No. 2006-346714

Patent Literature 5: Japanese Patent No. 3801145

Non-Patent Literature

Non-Patent Literature 1: S. P. Timoshenko, J. N. Goodier, "Theory of Elasticity THIRD EDITION", McGRAW-HILL BOOK COMPANY INTERNATIONAL EDITION 1970

Non-Patent Literature 2: "Theory and Practice of Strip Rolling", The Iron and Steel Institute of Japan, Sep. 1st, 1984

SUMMARY OF INVENTION

Technical Problem

By the way, in Patent Literature 1, the output torque of the drive motor is converted to the tension. The output torque of the drive motor contains the torque for acceleration and deceleration of the pinch rolls and the torque of rotational resistance of bearing portions of the pinch rolls. Generally, the speed of a hot-rolled steel strip is low during threading of the leading end thereof, is thereafter accelerated, and is then decelerated before the trailing end thereof passes. This acceleration and deceleration causes a torque fluctuation based on the moment of inertia of the machine around the pinch rolls, during rolling. Therefore, the tension needs to be controlled to a certain set value taking into consideration the torque fluctuation. It is however difficult to cause the tension acting on a hot-rolled steel strip to coincide with the target tension actually, leading to a difference between the actual tension and the target tension. In addition, Patent Literature 1 describes a measure to reduce the moment of inertia of the pinch rolls, but even if the moment of inertia is reduced, it is unavoidable that torque change that inverts for each of acceleration and deceleration causes tension change, and a difference from actual tension arises. Since the actual tension cannot precisely be found, it can be said to be difficult to maintain the set tension stably.

In addition, if cooling is not performed during threading of the leading end of the hot-rolled steel strip but is performed after the leading end is bitten between the pinch rolls, the friction coefficient between the pinch rolls and the hot-rolled steel strip during threading of the leading end is different from that after the cooling starts. In addition to such a condition like whether it is dry or wet, the friction coefficient is influenced by surface roughness of the hot-rolled steel strip, wearing of the surfaces of the pinch rolls, and the like. A precise value of the friction coefficient is required to control the tension by the output torque of the drive motor, but it is practically difficult to find the friction coefficient in each of the above conditions (disturbances). Therefore, when the tension is controlled by the pinch rolls whose friction coefficient with the hot-rolled steel strip is unstable, the tension thus found contains a lot of errors. Therefore, the rolling proceeds with a difference between the target tension and the actual tension while the tension is set by the pinch rolls. If the actual tension decreases extremely, such problems arise that the hot-rolled steel strip flaps vertically in the cooling apparatus and thus cannot be uniformly cooled; the hot-rolled steel strip comes into contact with upper and lower guide apparatuses and is scratched; and threading becomes impossible. On the other hand, if the tension increases extremely, a problem arises that the increase in tension causes strip thickness fluctuation, such as thinning of the strip thickness of the hot-rolled steel strip.

Furthermore, problems in detecting tension by the pinch rolls will be described below in detail.

A motor output Tr is expressed by Tr=Trt+Trd, where Trt is a torque for tension, Trd is a torque for rotating the pinch roll.

Trt=Tr−Trd, and a tension Ft is expressed by Ft=Trt/R, where R is a radius of the pinch roll.

Therefore, the tension Ft can be calculated by subtracting Trd from the measureable Tr.

Trd, however, contains significant fluctuation factors that are required for rotational control of the pinch roll itself, such as changes in conditions between the pinch roll and the strip, and acceleration and deceleration. Trd can be expressed as a disturbance in calculating the tension.

The disturbance is expressed as follows:

$$Trd=Trd1+Trd2+Trd3+\ldots$$

Trd1: torque fluctuating according to acceleration and deceleration . . . . This torque fluctuates significantly during rolling, since the speed is low during threading, is thereafter accelerated, and is then decelerated before the trailing end passes. It is very difficult to put tension into a certain set value taking this torque fluctuation into consideration, and actual fluctuation in tension is difficult to avoid. Patent Literature 1 describes a measure to reduce the moment of inertia of the pinch rolls. However, it is difficult to perform control to prevent the moment of inertia from causing torque change that inverts for each of acceleration and deceleration to cause tension change, and it is difficult to maintain the set tension stably.

Trd2: a change in rolling resistance of the pinch roll . . . . Even if pressing force of the pinch rolls is constant, the rolling resistance changes according to a change in speed. It is thought that a measure such as reducing the absolute value of the rolling resistance is required to take no account of change in the rolling resistance.

Trd3: a change in strip thickness during rolling . . . . If a mechanical system has hysteresis according to vertical movement of the pinch roll, net pressing force (force to press the strip) changes. Therefore, the tension fluctuates.

A little consideration of Tr will be made below.

For example, a friction coefficient μ (μ curve organized by the vertical axis: traction coefficient and the horizontal axis: slipping velocity or slip factor) changes during application of the tension by the pinch roll. The dried hot-rolled steel strip is caused to be put into a wet state when cooling has started, and put into a wet state when cooling has started, and in this process the g curve changes from moment to moment. If it is intended to control this μ curve by a motor output torque, a precise μ value is required, but since μ is affected by temperature or surface conditions (roughness, dry or wet, and the like) of the hot-rolled steel strip, friction of the pinch roll surface, and the like, it is thought to be difficult to get this μ.

Since such a problem arises similarly in Patent Literature 2 where the damming roll is used as the pinch roll, it is impossible to measure the tension precisely.

In addition, in order to perform cooling properly, jetting cooling water with the leading end of the hot-rolled steel strip tensioned is required. If the leading end is not tensioned, jetting of cooling water causes the hot-rolled steel strip to become unstable in the vertical direction (as well as in a strip-widthwise direction and in a rolling direction), and there is a disadvantage that the cooling becomes non-uniform. In addition, there are also disadvantages that the hot-rolled steel strip is scratched by contact with the upper and lower guide apparatuses, that the threading is blocked, and the like. Therefore, tension requires to be applied to the leading end of the hot-rolled steel strip as early as possible.

Furthermore, even if tension can be set early and simply by the pinch rolls disposed in the vicinity of the delivery side of the cooling apparatus installed near the delivery side of the finishing mill line, the strip shape of the hot-rolled steel strip is not known at that time. If the strip shape is bad, the hot-rolled steel strip is cooled non-uniformly in the cooling apparatus, and cooling unevenness arises, but neither Patent Literature 1 nor 2 takes this into consideration.

The finishing mill generally adopts a strip shape measuring system for observing an apparent shape of a hot-rolled steel strip with no tension applied before the tension is set by coiling the leading end of the hot-rolled steel strip by a down coiler. When the cooling apparatus is disposed near the delivery side of the finishing mill line, and adjacent pinch rolls are disposed on the delivery side of the cooling apparatus, the apparent shape observation is performed on the delivery side of the adjacent pinch rolls. Based on the result of shape observation, the shape is modified by a rolling mill. However, the yield decreases, because a portion produced with a defective shape portion not being adjusted becomes longer according to separation of the position of shape observation from the finishing mill line. On the other hand, if the position of shape observation is set near the delivery side of the finishing mill line in order to measure the shape early, the cooling apparatus in the vicinity of the delivery side of the finishing mill line is separated from the finishing mill line accordingly, and therefore material manufacturing by rapid cooling immediately after rolling becomes impossible.

It should be noted that Patent Literature 3 discloses a technique to dispose a shape detector in the vicinity of a delivery side of a wiping apparatus in a cooling apparatus in the vicinity of a rolling mill. This technique however relates to cold rolling, and the technical field is different from the present invention which relates to hot rolling. Since Patent Literature 3 does not include a description about the pinch rolls, it can be assumed that the tension is applied by a coiler, and this configuration is different from that of the present invention where the tension is applied by the pinch rolls.

Therefore, an object of the present invention is to provide a manufacturing device and a manufacturing method for a hot-rolled steel strip capable of obtaining desired material by uniform rapid cooling immediately after rolling, and improving the yield by early strip tension and strip shape measurement.

Solution to Problem

The present invention to achieve the object is a manufacturing device for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, and a tension measuring apparatus for measuring tension of the hot-rolled steel strip is installed between the wiping roll and the pinch rolls.

Further:

the tension measuring apparatus has a roll for providing an arbitrary winding angle to the hot-rolled steel strip, and the tension measuring apparatus measures pressing force applied to the roll due to the winding angle to thereby determine tension acting on the hot-rolled steel strip.

Further, a manufacturing device for a hot-rolled steel strip, comprises: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, and a shapemeter for measuring strip shape of the hot-rolled steel strip is installed between the wiping roll and the pinch rolls.

Further, the shapemeter has a plurality of rolls, separated in a strip-widthwise direction of the hot-rolled steel strip, for providing an arbitrary winding angle to the hot-rolled steel strip, and the shapemeter measures a strip-widthwise distribution of pressing forces applied to the respective rolls due to the winding angle, determines a tension distribution from the distribution of pressing forces, and determines the strip shape from the tension distribution.

Further:

the tension measuring apparatus and the shapemeter are an identical apparatus.

Further:

the tension measuring apparatus and/or the shapemeter form the winding angle on the upper portion of the roll.

Further:

the tension measuring apparatus and/or the shapemeter is configured such that when the tension of the hot-rolled steel strip between the finishing mill line and the pinch rolls is going to vary, the winding angle changes to reduce fluctuation in tension as much as possible.

Further:

the wiping roll is a drive roll and configured such that a rotational resistance of the wiping roll itself to the hot-rolled steel strip is reduced as much as possible.

Further:

a manufacturing device of a hot-rolled steel strip, comprises: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a shapemeter for measuring strip shape of the hot-rolled steel strip is installed between the wiping roll and the pinch rolls, and further a hot-rolled steel strip temperature measuring apparatus for measuring a strip-widthwise temperature distribution in the hot-rolled steel strip is installed in a region including a range from the wiping roll to an air cooling zone provided on a delivery side of the pinch rolls.

Further:

the hot-rolled steel strip temperature apparatus is installed between the wiping roll and the pinch rolls.

The present invention to achieve the above object is a manufacturing method for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a tension measuring apparatus for measuring tension of the hot-rolled steel strip and/or a shapemeter for measuring strip shape of the hot-rolled steel strip is installed between the wiping roll and the pinch rolls, and a roll of the tension measuring apparatus and/or the shapemeter forms an arbitrarily determined target winding angle to the hot-rolled steel strip after a leading end of the hot-rolled steel strip is caught between the pinch rolls.

Further:

the roll of the tension measuring apparatus and/or the shapemeter is set at an arbitrarily determined target winding angle to the hot-rolled steel strip after a leading end of the hot-rolled steel strip is caught between the pinch rolls, thereafter the winding angle is kept at approximately the same value during rolling is performed, and the winding angle is canceled before a trailing end of the hot-rolled steel strip passes through the roll.

Further:

a manufacturing method for a hot-rolled steel strip, comprises: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a shapemeter for measuring strip shape of the hot-rolled steel strip is installed between the wiping roll and the pinch rolls, and a shape adjusting function of a rolling mill at least in a last stand of the finishing mill line is operated while the strip shape under cooling by the cooling apparatus is being detected.

Further:

an air cooling zone is provided on a delivery side of the pinch rolls, a hot-rolled steel strip temperature measuring apparatus for measuring a strip-widthwise temperature distribution in the hot-rolled steel strip is installed in a region including a range from the wiping roll to the air cooling zone on the delivery side of the pinch rolls, the strip shape obtained by the shapemeter is compensated for by a distribution of elongation differences in a rolling direction based on the strip-widthwise temperature distribution, and the shape adjusting function of the rolling mill at least in the last stand of the finishing mill line is operated such that the strip shape after the compensation becomes a target shape.

Advantageous Effects of Invention

According to the manufacturing device and the manufacturing method for a hot-rolled steel strip according to the present invention thus configured, the cooling apparatus installed immediately after the delivery side of the finishing mill line makes rapid cooling immediately after rolling possible, making it possible to obtain a hot-rolled steel strip made of a fine-grained structure where, for example, a grain size of a ferrite structure is 3 to 4 μm or less. In addition, since the tension measuring apparatus and/or the shapemeter is installed between the wiping roll and the pinch rolls, early measurement of strip tension and strip shape makes uniform cooling possible, so that cooling unevenness is minimized, and a stable rolling state is obtained, so that the yield is improved.

BRIEF DESCRIPTION OF DRAWINGS

FIG. 1 is an overall configuration view of hot rolling equipment showing Example 1 of the present invention.

FIG. 2 is an enlarged view of an important part of FIG. 1 showing an installation position of a strip-tension and strip-shape measuring apparatus.

FIG. 3 is an enlarged view of an important part of FIG. 1 showing a winding angle of the strip-tension and strip-shape measuring apparatus.

FIG. 4A is respective characteristic graphs of shape control of a last stand of a finishing mill line.

FIG. 4B is respective characteristic graphs of shape control of the last stand of the finishing mill line.

FIG. 5A is a calculation model and respective relationship diagrams based on Non-Patent Literature 1.

FIG. 5B is respective relationship diagrams based on Non-Patent Literature 1.

FIG. 6 is an enlarged view of an important part of hot rolling equipment showing Example 2 of the present invention.

DESCRIPTION OF EMBODIMENT

Hereinafter, examples of a manufacturing device and a manufacturing method for a hot-rolled steel strip according to the present invention will be described in detail with reference to the drawings.

Example 1

Figure 1:
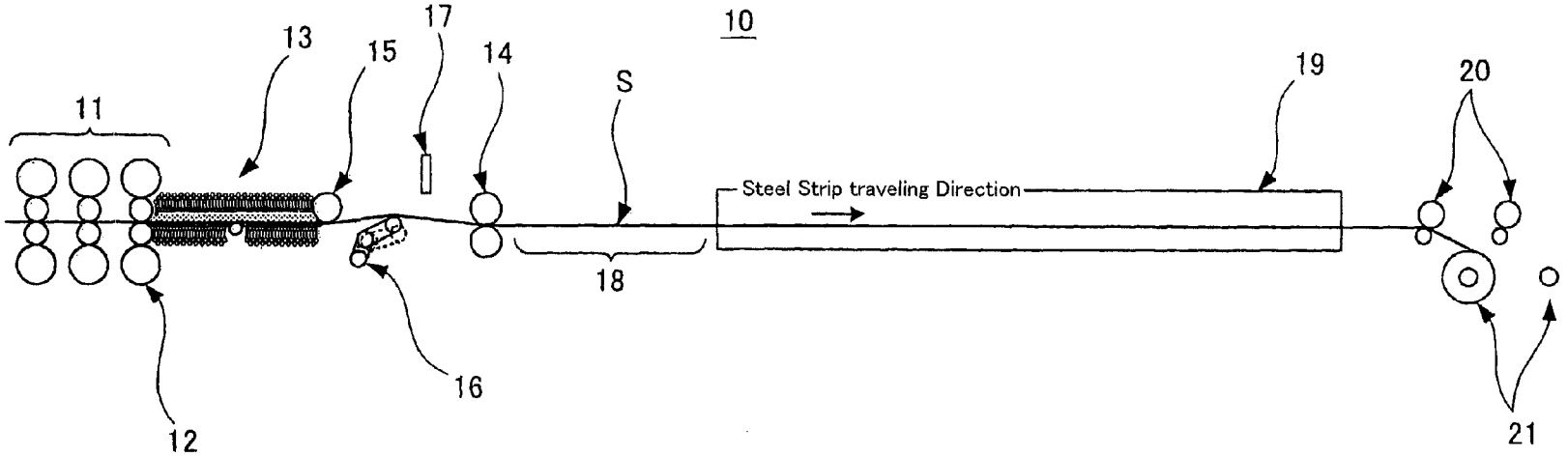
[FIG. 1]
Figure 2:
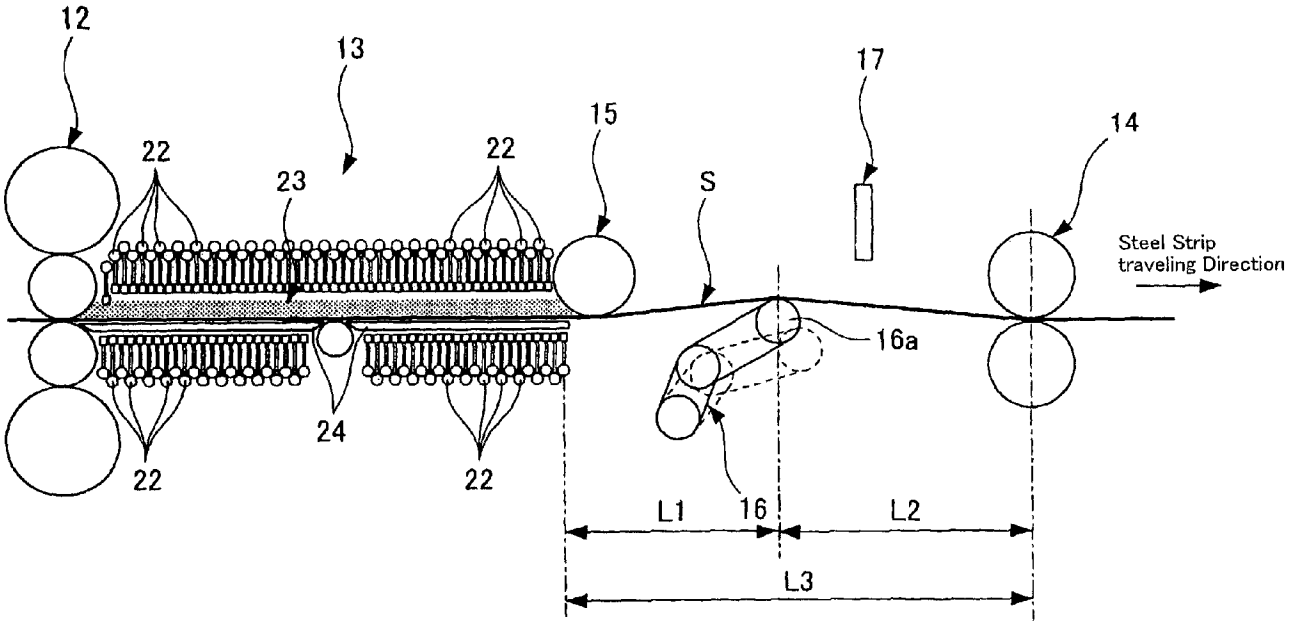
[FIG. 2]
Figure 3:
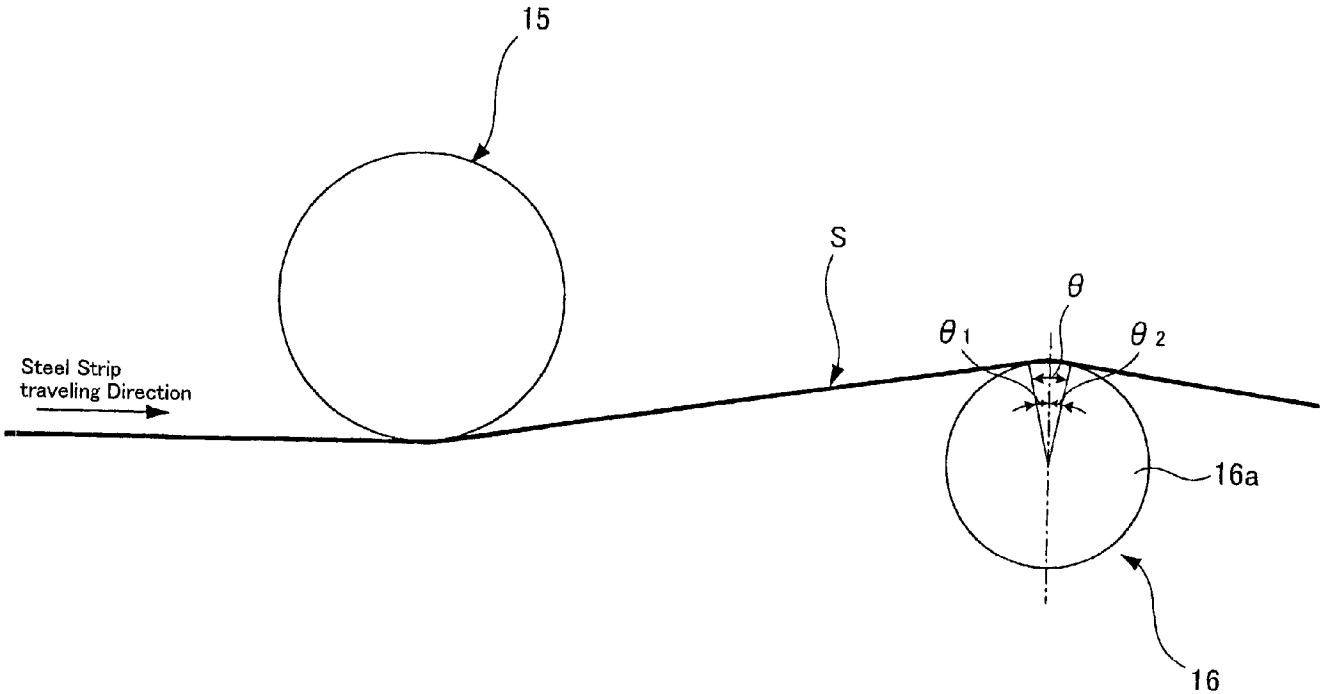
[FIG. 3]
Figure 4A:
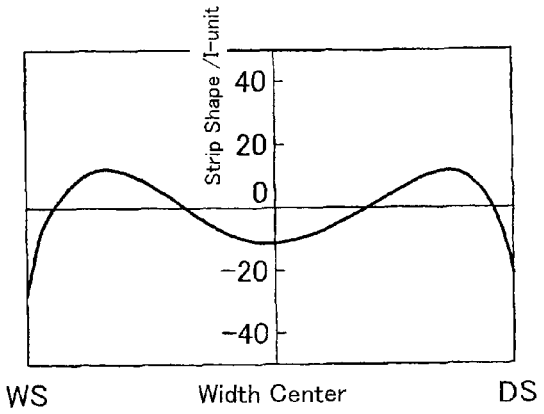
[FIG. 4A]
Figure 4A:
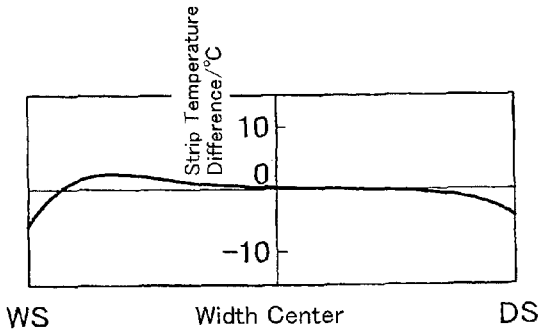
Figure 4A:
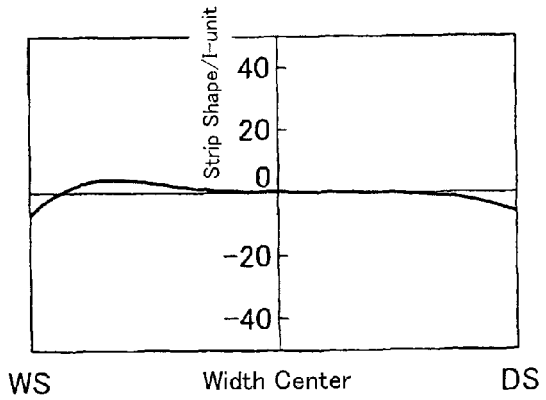
Figure 4B:
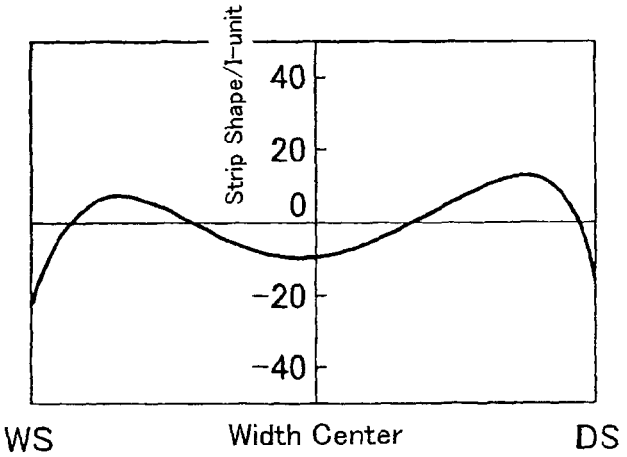
[FIG. 4B]
Figure 4B:
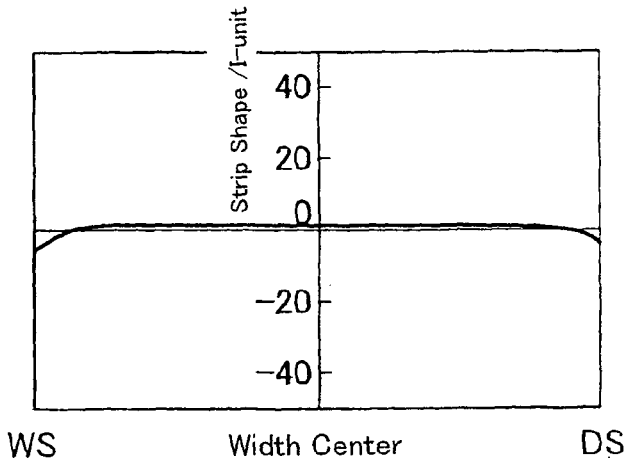
Figure 5A:
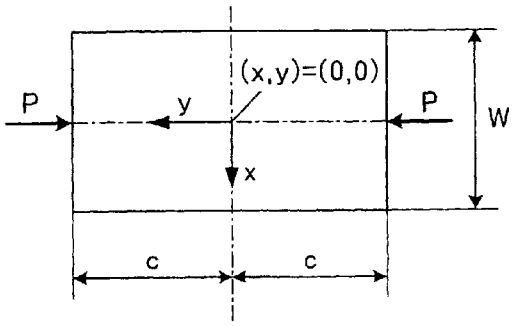
[FIG. 5A]
Figure 5A:
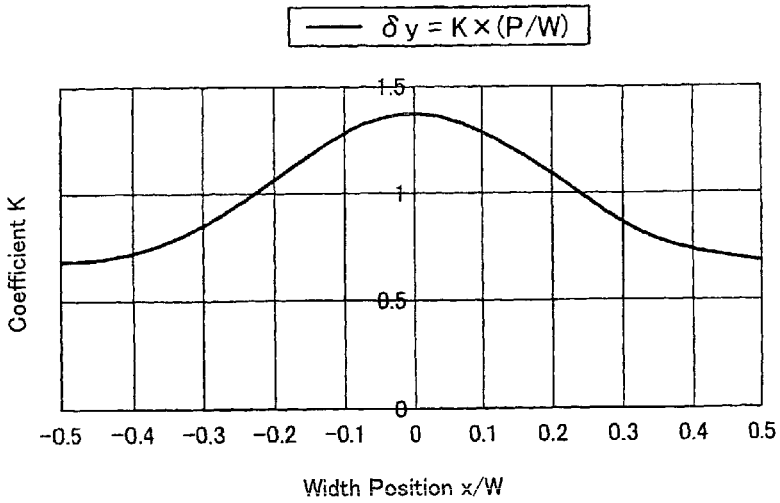
Figure 5B:
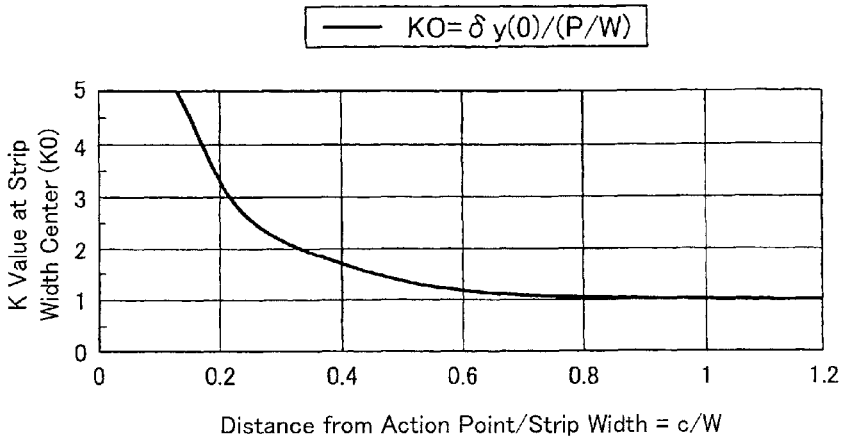
[FIG. 5B]
Figure 5B:
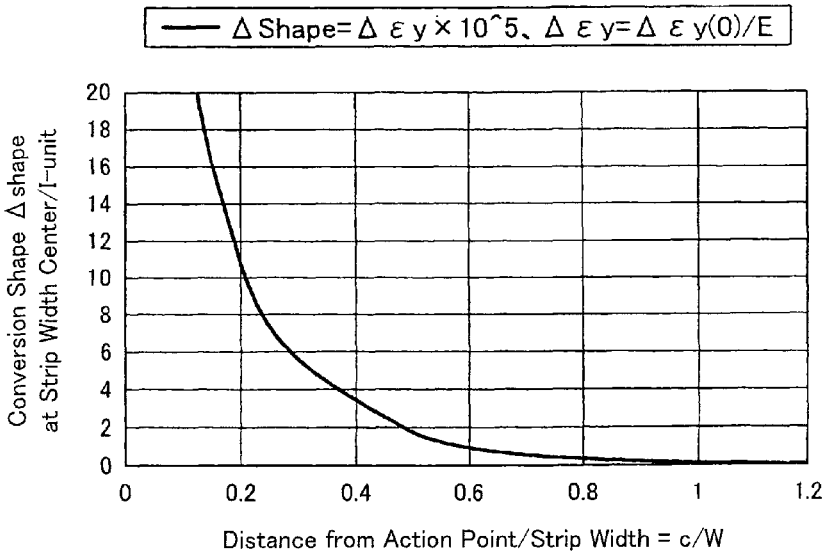

FIG. 1 is an overall configuration view of hot rolling equipment showing Example 1 of the present invention, FIG. 2 is an enlarged view of an important part of FIG. 1 showing an installation position of a strip-tension and strip-shape measuring apparatus, FIG. 3 is an enlarged view of an important part of FIG. 1 showing a winding angle of the strip-tension and strip-shape measuring apparatus, FIGS. 4A and 4B are characteristic graphs of shape control of a last stand of a finishing mill line, FIG. 5A is a calculation model and respective relationship diagrams based on Non-Patent Literature 1, and FIG. 5B is respective relationship diagrams based on Non-Patent Literature 1.

As shown in FIG. 1, hot rolling equipment 10 includes: a first cooling apparatus 13 installed immediately after a delivery side of a last stand 12 of a finishing mill line 11; and pinch rolls 14 installed on a delivery side of the first cooling apparatus 13 and abutting on the upper and lower faces of a strip (hot-rolled steel strip) S. In addition, a wiping roll 15 is disposed between the first cooling apparatus 13 and the pinch rolls 14. Moreover, a contact-type tension/shape measuring apparatus 16 and a temperature measuring apparatus (hot-rolled steel strip temperature measuring apparatus) 17 are provided between the wiping roll 15 and the pinch rolls 14. The contact-type tension/shape measuring apparatus 16 is for measuring tension and shape of the strip S, and the temperature measuring apparatus 17 is for measuring a strip-widthwise temperature distribution of the strip S.

And, a second cooling apparatus 19 is disposed on a delivery side of the pinch rolls 14 with an air cooling zone (measuring zone) 18, and down coilers 21 are installed on a delivery side of the second cooling apparatus 19 in a two-stage fashion in a conveyance direction of the strip S via pre-coiler pinch rolls 20. It should be noted that in the air cooling zone (measuring zone) 18, strip thickness measurement, strip profile (widthwise distribution of strip thicknesses) measurement, strip shape measurement before tension acts, strip temperature measurement, and the like are generally performed.

Therefore, the strip S which has passed through the last stand 12 of the finishing mill line 11 is conveyed to the first cooling apparatus 13→the wiping roll 15→the tension/shape measuring apparatus 16→the pinch rolls 14→the air cooling zone 18→the second cooling apparatus 19→the pre-coiler pinch rolls 20, and thereafter coiled up by the down coiler 21. It should be noted that, in this regard, it is preferred that a pass line of the finishing mill line 11 (in particular, the last stand 12) be at approximately the same level as the other pass lines, because this enables favorable jetting of cooling water in the first cooling apparatus 13, which will be described later.

As shown in FIG. 2, the first cooling apparatus 13 can rapidly cool the strip S by jetting a large amount of cooling water from a large number of nozzles 22 directly to both the upper and lower faces of the strip S at a cooling rate of, for example, about 1000° C./s. Specifically, the cooling water is jetted to the upper face of the strip S via a cooling water pool 23 defined by rolls of the last stand 12 and the wiping roll 15, and the cooling water is jetted to the lower face of the strip S through a large number of unillustrated jet holes formed in a threading apron 24.

As shown in FIG. 3, the tension/shape measuring apparatus 16 is installed under the strip S. The tension/shape measuring apparatus 16 has a plurality of rolls 16*a* separated in a strip-widthwise direction of the strip S and providing the lower face of the strip S with a certain winding angle (winding angle $\theta=\theta_1+\theta_2$). The tension/shape measuring apparatus 16 measures a strip-widthwise distribution of pressing forces applied to the rolls 16*a* due to the winding angle θ, determines a tension distribution from the distribution of pressing forces, and determines strip shape from the tension distribution. It should be noted that the tension/shape measuring apparatus 16 has already been suggested in Patent Literature 4 by the present applicant and the like, and therefore Patent Literature 4 is incorporated herein by reference to omit the detailed description of the tension/shape measuring apparatus 16. The following is another method other than the method to measure the total of the tension distributions as the tension of the strip S. That is, the tension/shape measuring apparatus 16 in FIGS. 1 and 2 turns from a position shown by the broken line to provide the winding angle θ to the strip S, but it is also possible to use a torque acting on the supporting point of this turn to detect tension, like a looper in the conventional finishing mill line 11.

Then, the rolls 16*a* of the tension/shape measuring apparatus 16 form an arbitrarily determined target winding angle θ to the strip S after a leading end of the strip S is caught between the pinch rolls 14, thereafter the winding angle θ is kept at approximately the same value while rolling is performed, and the winding angle θ is cancelled before a trailing end of the strip S passes through the rolls 16*a*.

In addition, since the wiping roll 15 does not pinch the strip S, even if the wiping roll 15 and the tension/shape measuring apparatus 16 are disposed near each other, the tension of a cooled portion can be precisely measured by the tension/shape measuring apparatus 16. Although described later, when a roll is disposed below the wiping roll 15 to pinch the strip S, a load distribution acts locally in the strip-widthwise direction because of a strip-widthwise distribution of pressure of contact with the strip S, a strip-widthwise distribution of friction coefficient, and the like; therefore, if the wiping roll 15 is disposed near the tension/shape measuring apparatus 16, there arises a problem that the local load distribution causes an error in strip shape measurement. In addition, the wiping roll 15, coming in contact with the upper face of the strip S, is configured of a drive roll so that rotational resistance of the wiping roll 15 itself to the strip S is low. It should be noted that, in this regard, bending acts on the strip S coming in contact with the wiping roll 15, but the bending acts on the front and back sides (upper and lower faces in a thickness direction) of the strip S as compression and tension whose absolute values are approximately equal to each other, and therefore does not affect on the tension, and does not generate a tension distribution in the strip-widthwise direction, so that the tension/shape measuring apparatus 16 can precisely measure strip shape even if the tension/shape measuring apparatus 16 is disposed near the wiping roll 15.

The temperature measuring apparatus 17 is disposed above the strip S between the wiping roll 15 and the pinch rolls 14. The temperature measuring apparatus 17 compensates for the strip shape determined by the tension/shape measuring apparatus 16 according to a distribution of elongation differences in a rolling direction based on a strip-widthwise temperature distribution, and operates a shape adjusting function of the rolling mill at least in the last stand 12 of the finishing mill line 11 so that the strip shape after the compensation becomes a target shape. The shape adjusting function of the rolling mill can be a mechanical control means, such as a roll bender or shift, or performing shape control by changing a widthwise flow rate distribution of a roll coolant (see Patent Literature 3). In addition, a system of crossing at least the work rolls of the rolling mill, or the like, can also be thought to be employed as the shape adjusting function.

Here, the shape control of the rolling mill in the last stand 12 of the finishing mill line 11 will be described based on characteristic graphs in FIGS. 4A and 4B.

(1) A characteristic (a) in FIG. 4A shows an example of the result of shape measurement by the tension/shape measuring apparatus 16. The result shows that the shape is a shape having elongation at quarter portions. On the other hand, a characteristic (b) in FIG. 4A shows a strip-widthwise temperature distribution. The strip-widthwise temperature distribution is the result of measurement by the temperature measuring apparatus 17 in FIG. 2. An elongation strain $\epsilon$ due to a temperature difference $\Delta t$ is expressed as $\epsilon=\alpha s\times\Delta t$, using a linear expansion coefficient $\alpha s$. For example, if $\alpha s=1.5\times10^{(-5)}$ (unit 1/° C.) and $\Delta t=5°$ C., then $\epsilon=7.5\times10^{(-5)}$. The elongation strain $\epsilon$ means an elongation difference ratio, and $\epsilon=1.0\times10^{(-5)}$ is 1 I-unit (a unit of measurement of flatness). A characteristic (c) in FIG. 4A is a value of the elongation difference ratio obtained from the temperature distribution of the characteristic (b) in FIG. 4A. From the fact that the widthwise temperature distribution exists as a result of measurement performed between the wiping roll 15 and the pinch rolls 14 after rolling and cooling, it is considered that the elongation difference ratio due to this temperature distribution has already existed. Since the result of shape measurement in that state is the characteristic (a) in FIG. 4A, a characteristic (d) in FIG. 4B=the characteristic (a) in FIG. 4A—the characteristic (c) in FIG. 4A is considered to be the shape before cooling on the delivery side of the finishing mill line. It is intended to compensate for the shape before cooling of the characteristic (d) in FIG. 4B by the shape control function of the last stand 12 so that the target shape of a characteristic (e) in FIG. 4B is obtained.

Thus, by adopting such a rolling method to cause a widthwise shape to coincide with the target shape when the same temperature has been reached, an excellent strip shape after the cooling can be obtained.

(2) On the other hand, in terms of stability of rolling, there is a different usage from the above method. If a widthwise tension distribution is approximately symmetrical and balanced, it can be said that the strip is in a condition to be unlikely to move transversally. If there is a large difference in widthwise tension distribution between a work side and a drive side, however, the strip is in a condition to move transversally easily. When this transverse movement of the strip becomes problematic, the tension distribution is required to be approximately widthwise symmetrical, and therefore, when a temperature distribution asymmetrical between the work side and the drive side is found, rolling stability is obtained by controlling the finishing mill line 11 so as to make the tension symmetrical.

Thus, operation combining (1) and (2), namely, operation satisfying both (1) and (2) is required.

In Example 1, a distance L1 from a cooling water hitting position in the first cooling apparatus 13 to the tension/shape measuring apparatus 16 and a distance L2 from the tension/shape measuring apparatus 16 to the pinch rolls 14 are each set at (0.5 to 1.0)×W (where W is a maximum strip width), so that a distance L3 from completion of jetting of cooling water to the pinch rolls 14 is as short as possible.

Here, an installation position of the tension/shape measuring apparatus 16 will be described based on Non-Patent Literature 1 and Non-Patent Literature 2. First, Non-Patent Literature 1 states on pages 58 to 60 such a tendency that when a concentrated load acts, a widthwise load distribution becomes more uniform away from a position where the load acts, and that the widthwise load distribution becomes much more uniform in a position separated by a distance equal to or more than a strip width.

From this, it can be qualitatively understood that the influence of the load acting on the strip S can be considerably reduced by measuring the strip shape at a location separated by at least a distance equal to or more than the strip width from the position where the load acts. Here, such local external force as to cause a tension distribution in the strip-widthwise direction on the entry side or on the delivery side of the position where the strip shape is measured can be thought to include widthwise local hitting force against the strip S by jetting of the cooling water in the first cooling apparatus 13, and non-uniformity in the widthwise pressing condition due to pinching the strip S by the pinch rolls 14. If the distance L1 from a load acting position, namely, the cooling water hitting position in the first cooling apparatus 13 to the tension/shape measuring apparatus 16, and the distance L2 from the tension/shape measuring apparatus 16 to the pinch rolls 14 are each equal to or more than the strip width, it is considered that a load of external force has much less effect on the shape measurement in the tension/shape measuring apparatus 16, since it is considered that the local load has better conditions than at least the concentrated load. However, there is a problem that the distance L3 from cooling completion to the pinch rolls 14 becomes longer.

A detailed analysis of this problem based on FIGS. 37 and 38 of Non-Patent Literature 1 is as follows. A calculation model is shown in (a) in FIG. 5A. A load P per unit length acts on the widthwise center as a concentrated load. A point separated by c from a place where the load P acts is set to y-coordinate=0.

A diagram (b) in FIG. 5A shows a relationship between a width position and a coefficient K at y=0 when c=0.5 W. The coefficient K is a ratio of the stress ($\sigma y$) in the strip-widthwise direction to a uniform stress (P/W). It can be seen that point where x/W is 0, namely, the strip-widthwise center, is a peak of the coefficient K, and that when c=0.5 W, a stress of about 1.4 times a uniform load exists at the strip-widthwise center.

A diagram (c) in FIG. 5B shows a relationship between a distance from a point of action/strip width and a K value at the strip-widthwise center (K0). The coefficient K0 is a ratio of the peak stress acting on the strip-widthwise center ($\sigma y$ (0)) to the uniform stress (P/W). When c/W is 1, K0 is a value fairly close to 1.0, and becomes even closer thereto as c/W increases, so that uniformity of the widthwise load distribution increases.

A diagram (d) in FIG. 5B shows a relationship between a distance from the point of action/strip width and a conversion shape $\Delta$shape at the strip-widthwise center. $\Delta\epsilon y$ shown in (d) is an elongation difference ratio corresponding to a stress difference $\Delta\sigma y(0)=\sigma y(0)-P/W$ between the stress $\sigma y(0)$ at the strip-widthwise center and the uniform stress P/W. Using $\Delta\epsilon y$, $\Delta$shape is calculated as $\Delta shape=\Delta\epsilon y\times10^{5}$, which has been expressed as the conversion shape. A unit of $\Delta$shape is I-unit. The definition of I-unit is according to, for example, page 266 of Non-Patent Literature 2.

In the calculation model (a) in FIG. 5A, the load P acts in a compressive direction, but the same tendency is obtained even if the load P acts in a tensile direction. A shapemeter is intended to measure an inherent strip shape of a rolled or cooled strip. Considering this, the action of a local load like the concentrated load is handled as a measurement error of strip shape measurement and exists as the conversion shape at a measurement point of the strip shape measurement.

The strip shape detected in rolling is generally 5 to 10 I-units or more. It is preferred that the conversion shape $\Delta$shape acting as an error in measuring the strip shape is made smaller, but it can be determined that 2 I-units or less of $\Delta$shape has less effect on detection of 5 to 10 I-units. From the diagram (d) in FIG. 5B, when c/W is 0.5 or more, $\Delta$shape is 2 I-units or less. That is, $\Delta$shape can be set to 2 I-units or less up to a position separated from the position where a local load acts by a distance of at least 0.5 times the strip width W, and thus the strip shape can be measured without an actual adverse influence on measurement. In addition, from the diagram (d) in FIG. 5B, when c/W becomes 0.5 or less, the conversion shape Δshape sharply increases and cannot be ignored as an error in measurement.

When pressured water such as, for example, spray water locally hits the strip by cooling jetting, tension on the hit portion in the rolling direction locally increases, and acts as a local load in the strip-widthwise direction. In addition, even in an engaging portion of the pinch rolls, a load distribution acts locally in the strip-widthwise direction because of a strip-widthwise distribution of contact pressure between the pinch rolls and the strip, a strip-widthwise distribution of friction coefficient, or the like. Although this local load distribution is not a shape inherent in the strip itself, the conversion shape Δshape can be suppressed to 2 I-units or less by measuring the strip shape in a position separated by a distance of at least 0.5 times the strip width W. In this way, the local load hardly affects the strip shape measurement. If the strip shape is measured at a position separated from the local load in the strip-widthwise direction only by a distance of 0.5 times the strip width W or less, the influence of the local load becomes an error in measurement, namely, disturbance, as local tension, and makes it difficult to measure the strip shape precisely.

From above, by installing the tension/shape measuring apparatus 16 at a position separated by a distance of (0.5 to 1.0)×W from a position where the local load acts, the distance from the completion of jetting of cooling water to the pinch rolls 14 in the first cooling apparatus 13 can be shortened, and the disturbance due to the load acting on the strip S can also be reduced even in measurement of the strip shape.

According to Example 1, the pinch rolls 14 are disposed apart from a cooling apparatus (the first cooling apparatus 13), and the wiping roll 15 and a non-water cooling zone (here, the zone between the wiping roll 15 and the pinch rolls 14) are provided therebetween. The cooling water jetted on the upper face of the strip S by the cooling apparatus is drained by the wiping roll 15, and the strip S is put in a drained state in the non-water cooling zone. The lower face of the strip S can be easily put in a waterless state in the non-water cooling zone because the cooling water drops downward. Since the non-water cooling zone is provided by installing the wiping roll 15, the drained state becomes stable, and a frictional state between the strip S and the pinch rolls 14 is stabilized, so that fluctuation of the friction coefficient, namely, a disturbance in the friction coefficient can be reduced. Furthermore, since the pinch rolls 14 are disposed apart from the cooling apparatus so that tension can be measured between the wiping roll 15 and the pinch rolls 14, it is possible to find actual tension without taking into consideration a disturbance generated by the apparatus, such as tension fluctuation based on the moment of inertia of the pinch rolls 14 themselves. This precise finding of the tension makes it easy to make adjustment to the target tension, so that it becomes possible to maintain the tension stably.

In addition, since the first cooling apparatus 13 is disposed immediately after the delivery side of the finishing mill line 11 and the tension/shape measuring apparatus 16 is disposed between the wiping roll 15 and the pinch rolls 14 so that the tension and the shape of the strip S can be measured or found early, material manufacturing can be achieved by rapid cooling immediately after rolling, making it possible to obtain a hot-rolled steel strip made of a fine-grained structure where a grain size of a ferrite structure is, for example, 3 to 4 μm or less and also to secure a high yield.

In this regard, as described above, the distance L1 from the cooling water hitting position in the first cooling apparatus 13 to the tension/shape measuring apparatus 16 and the distance L2 from the tension/shape measuring apparatus 16 to the pinch rolls 14 are each set at (0.5 to 1.0)×W (maximum strip width), and the distance L3 from the completion of jetting of cooling water to the pinch rolls 14 is made as short as possible. Accordingly, in combination with an effective draining action performed by the wiping roll 15 described above, it is possible to raise the yield while maintaining high measurement precision of the tension/shape measuring apparatus 16.

In addition, since the tension/shape measuring apparatus 16 is provided between the wiping roll 15 and the pinch rolls 14, uniform cooling is made possible by early measurement of strip tension and strip shape, which results in minimization of cooling unevenness, and a stable rolling state is obtained, so that improvement in yield can be achieved. In addition, since the tension/shape measuring apparatus 16 is unified as a single apparatus, more space can be saved than in the case of disposing separate apparatuses.

In addition, the temperature measuring apparatus 17 compensates for the strip shape obtained by the tension/shape measuring apparatus 16, according to the distribution of elongation differences in the rolling direction based on the strip-widthwise temperature distribution, and causes the shape adjusting function of the rolling mill at least in the last stand 12 of the finishing mill line 11 to operate such that the strip shape after the compensation becomes a target shape. Accordingly, the strip shape of the strip S which has passed through the finishing mill line 11 has already been adjusted to the target shape, and therefore cooling unevenness is even more unlikely to occur. Of course, it is also possible to perform shape adjustment of the strip S in the rolling mill in at least the last stand 12 of the finishing mill line 11, while detecting the strip shape during cooling by the tension/shape measuring apparatus 16, without performing temperature measurement by the temperature measuring apparatus 17. It should be noted that the above compensation is performed more precisely by installing the temperature measuring apparatus 17 at a position close to the tension/shape measuring apparatus 16.

In addition, the rolls 16*a* of the tension/shape measuring apparatus 16 form an arbitrarily determined target winding angle θ to the strip S after the leading end of the strip S is caught between the pinch rolls 14, thereafter the winding angle θ is kept at approximately the same value while rolling is performed, and the winding angle θ is cancelled before the trailing end of the strip S passes through the rolls 16*a*. Therefore, an arbitrarily determined target tension and shape can be set immediately after the leading end of the strip S is caught between the pinch rolls 14, and cooling can be started early, so that the yield is further improved. In addition, since the winding angle θ is approximately constant during rolling, the rolls 16*a* of the tension/shape measuring apparatus 16 do not need to be of a type where a looper moves vertically like a configuration between stands in the finishing mill line 11. In this case, since the winding angle θ is set to be constant, the apparatus becomes simple.

Example 2

Figure 6:
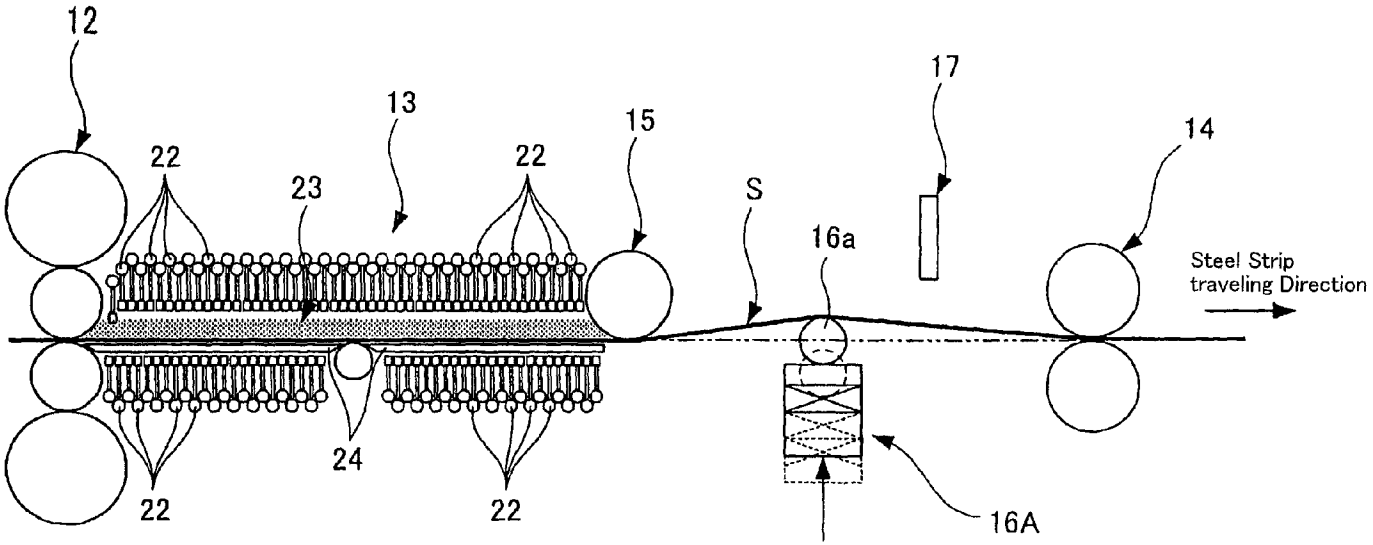
[FIG. 6]

FIG. 6 is an enlarged view of an important part of hot rolling equipment showing Example 2 of the present invention.

This is an example where the tension/shape measuring apparatus 16 in Example 1 is changed to a simple tension measuring apparatus 16A, and shape measurement is performed by a shape measuring means in the air cooling zone 18 (see FIG. 1). The tension measuring apparatus 16A has load cells incorporated in bearing portions at both ends of a non-separated continuous single roll 16*a*, and measures tension of the entire strip S by urging the roll 16*a* against the lower face of the strip S by a pantograph mechanism or the like.

In addition, the shape measuring means in the air cooling zone 18 adopts a strip shape measuring system that observes an apparent shape of a hot-rolled steel strip, and the shape measuring means measures the shape while tension is not acting, before the down coiler 21 coils the leading end of the strip S and tension acts, and shape adjustment is performed in the finishing mill line 11 using the result of the shape measurement.

In Example 2, the same operation and effect as in Example 1 can be obtained.

By the way, generally, since the strip S is not rolled by the pinch rolls 14, fluctuation in tension of the strip S between the pinch rolls 14 and the last stand 12 after the leading end of the strip S is caught between the pinch rolls 14 is supposedly smaller than fluctuation in tension between stands in the finishing mill line 11. However, large fluctuation in tension is sometimes going to occur. In such a case, even when the measurement result of the tension/shape measuring apparatus 16 is used to control a motor drive of the pinch rolls 14, tension-responsive control of the motor drive of the pinch rolls 14 cannot keep up, and therefore fluctuation in tension arises.

Here, the causes of the large fluctuation in tension going to occur include a sudden change in friction coefficient between the pinch rolls 14 and the strip S due to the start of cooling by the first cooling apparatus 13, and the like. Thus, when the large fluctuation in tension is going to occur, the fluctuation in tension of the strip S can be reduced as much as possible by moving the tension/shape measuring apparatus 16 vertically, thereby changing the winding angle θ like the present invention, in the same manner as a looper used between the stands in the finishing mill line 11. This makes it possible to reduce the fluctuation in tension of the strip S between the pinch rolls 14 and the last stand 12 as much as possible.

In addition, it goes without saying that the present invention is not limited to the above Examples 1 and 2, and that various modifications are possible, such as a structural change of the first cooling apparatus 13 or the tension/shape measuring apparatus 16, without departing from the scope of the present invention. In particular, it is preferred that the cooling apparatus disclosed in Patent Literature 5 by the present applicant and the like be used as the first cooling apparatus 13.

INDUSTRIAL APPLICABILITY

The manufacturing device and manufacturing method for a hot-rolled steel strip according to the present invention are applicable to iron-making process lines.

REFERENCE SIGNS LIST

10 Hot Rolling Equipment
11 Finishing Mill Line
12 Last Stand
13 First Cooling Apparatus
14 Pinch Rolls
15 Wiping Roll
16 Tension/Shape Measuring Apparatus
16A Tension Measuring Apparatus
16*a* Roll
17 Temperature Measuring Apparatus
18 Air Cooling Zone
19 Second Cooling Apparatus
20 Pre-Coiler Pinch Rolls
21 Down Coiler
22 Nozzle
23 Cooling Water Pool
24 Threading Apron
S Strip
θ Winding Angle

The invention claimed is:

1. A manufacturing device for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, and a tension measuring apparatus for measuring tension of the hot-rolled steel strip is installed between the wiping roll and the pinch rolls.

2. The manufacturing device for a hot-rolled steel strip according to claim 1, wherein the tension measuring apparatus has a roll for providing an arbitrary winding angle to the hot-rolled steel strip, and the tension measuring apparatus measures pressing force applied to the roll due to the winding angle to thereby determine tension acting on the hot-rolled steel strip.

3. The manufacturing device for a hot-rolled steel strip according to claim 1, wherein the tension measuring apparatus and the shapemeter are an identical apparatus.

4. The manufacturing device for a hot-rolled steel strip according to claim 1, wherein the tension measuring apparatus and/or the shapemeter form the winding angle on the upper portion of the roll.

5. The manufacturing device for a hot-rolled steel strip according to claim 1, wherein the tension measuring apparatus and/or the shapemeter is configured such that when the tension of the hot-rolled steel strip between the finishing mill line and the pinch rolls is going to vary, the winding angle changes to reduce fluctuation in tension as much as possible.

6. The manufacturing device for a hot-rolled steel strip according to claim 1, wherein the wiping roll is a drive roll and configured such that a rotational resistance of the wiping roll itself to the hot-rolled steel strip is reduced as much as possible.

7. A manufacturing device for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of the hot-rolled steel strip, wherein a wiping roll positioned at least above the hot-rolled steel strip is disposed between the cooling apparatus and the pinch rolls, and a shapemeter for measuring strip shape of the hot-rolled steel strip is installed between the wiping roll and the pinch rolls.

8. The manufacturing device for a hot-rolled steel strip according to claim 7, wherein the shapemeter has a plurality of rolls, separated in a strip-widthwise direction of the hot-rolled steel strip, for providing an arbitrary winding angle to the hot-rolled steel strip, and the shapemeter measures a strip-widthwise distribution of pressing forces applied to the respective rolls due to the winding angle, determines a tension distribution from the distribution of pressing forces, and determines the strip shape from the tension distribution.

9. The manufacturing device for a hot-rolled steel strip according to claim 7, wherein the tension measuring apparatus and the shapemeter are an identical apparatus.

10. The manufacturing device for a hot-rolled steel strip according to claim 7, wherein the tension measuring apparatus and/or the shapemeter form the winding angle on the upper portion of the roll.

11. The manufacturing device for a hot-rolled steel strip according to claim 7, wherein the tension measuring apparatus and/or the shapemeter is configured such that when the tension of the hot-rolled steel strip between the finishing mill line and the pinch rolls is going to vary, the winding angle changes to reduce fluctuation in tension as much as possible.

12. The manufacturing device for a hot-rolled steel strip according to claim 7, wherein the wiping roll is a drive roll and configured such that a rotational resistance of the wiping roll itself to the hot-rolled steel strip is reduced as much as possible.

13. A manufacturing device of a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a shapemeter for measuring strip shape of the hot-rolled steel strip is installed between the wiping roll and the pinch rolls, and further a hot-rolled steel strip temperature measuring apparatus for measuring a strip-widthwise temperature distribution in the hot-rolled steel strip is installed in a region including a range from the wiping roll to an air cooling zone provided on a delivery side of the pinch rolls.

14. The manufacturing device for a hot-rolled steel strip according to claim 13, wherein the hot-rolled steel strip temperature measuring apparatus is installed between the wiping roll and the pinch rolls.

15. A manufacturing method for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a tension measuring apparatus for measuring tension of the hot-rolled steel strip and/or a shapemeter for measuring strip shape of the hot-rolled steel strip is installed between the wiping roll and the pinch rolls, and a roll of the tension measuring apparatus and/or the shapemeter forms an arbitrarily determined target winding angle to the hot-rolled steel strip after a leading end of the hot-rolled steel strip is caught between the pinch rolls.

16. The manufacturing method for a hot-rolled steel strip according to claim 15, wherein the roll of the tension measuring apparatus and/or the shapemeter is set at an arbitrarily determined target winding angle to the hot-rolled steel strip after a leading end of the hot-rolled steel strip is caught between the pinch rolls, thereafter the winding angle is kept at approximately the same value during rolling is performed, and the winding angle is canceled before a trailing end of the hot-rolled steel strip passes through the roll.

17. A manufacturing method for a hot-rolled steel strip, comprising: a finishing mill line; a cooling apparatus installed immediately after a delivery side of the finishing mill line; and pinch rolls installed on a delivery side of the cooling apparatus and abutting on both upper and lower faces of a hot-rolled steel strip, wherein a wiping roll positioned at least above the hot-rolled steel strip is disposed between the cooling apparatus and the pinch rolls, a shapemeter for measuring strip shape of the hot-rolled steel strip is installed between the wiping roll and the pinch rolls, and a shape adjusting function of a rolling mill at least in a last stand of the finishing mill line is operated while the strip shape under cooling by the cooling apparatus is being detected.

18. The manufacturing method for a hot-rolled steel strip according to claim 17, wherein an air cooling zone is provided on a delivery side of the pinch rolls, a hot-rolled steel strip temperature measuring apparatus for measuring a strip-widthwise temperature distribution in the hot-rolled steel strip is installed in a region including a range from the wiping roll to the air cooling zone on the delivery side of the pinch rolls, the strip shape obtained by the shapemeter is compensated for by a distribution of elongation differences in a rolling direction based on the strip-widthwise temperature distribution, and the shape adjusting function of the rolling mill at least in the last stand of the finishing mill line is operated such that the strip shape after the compensation becomes a target shape.

* * * * *